US008746595B2

(12) United States Patent
Margheritis et al.

(10) Patent No.: US 8,746,595 B2
(45) Date of Patent: Jun. 10, 2014

(54) PUMP FOR DISPENSING A FLUID PRODUCT

(75) Inventors: Antonio Margheritis, Cittiglio (IT); Guido Dallara, Lugano (CH); Emanuele Maretto, Guanzate (IT)

(73) Assignee: Aptar France SAS, Le Neubourg (FR)

( * ) Notice: Subject to any disclaimer, the term of this patent is extended or adjusted under 35 U.S.C. 154(b) by 388 days.

(21) Appl. No.: 13/003,516

(22) PCT Filed: Jul. 10, 2009

(86) PCT No.: PCT/FR2009/051375

§ 371 (c)(1),
(2), (4) Date: Jan. 10, 2011

(87) PCT Pub. No.: WO2010/004224

PCT Pub. Date: Jan. 14, 2010

(65) Prior Publication Data

US 2011/0114676 A1 May 19, 2011

(30) Foreign Application Priority Data

Jul. 11, 2008 (FR) ..... 08 54758

(51) Int. Cl.
*B05B 1/34* (2006.01)

(52) U.S. Cl.
USPC ..... 239/483; 239/492; 239/468

(58) Field of Classification Search
USPC ..... 239/373, 483, 333, 482, 491
See application file for complete search history.

(56) References Cited

U.S. PATENT DOCUMENTS

| | | | | |
|---|---|---|---|---|
| 6,053,433 | A * | 4/2000 | Py | 239/574 |
| 6,609,666 | B1 | 8/2003 | Blake | |
| 7,775,404 | B2 | 8/2010 | Pardonge et al. | |
| 7,870,978 | B2 | 1/2011 | Pardonge et al. | |
| 2002/0030069 | A1 * | 3/2002 | Auer | 222/481.5 |
| 2002/0088873 | A1 | 7/2002 | Blake | |
| 2003/0197031 | A1 | 10/2003 | Petit | |
| 2004/0026457 | A1 | 2/2004 | Petit | |
| 2007/0131799 | A1 | 6/2007 | Le Maner et al. | |

FOREIGN PATENT DOCUMENTS

| | | | |
|---|---|---|---|
| CN | 1886202 | A | 12/2006 |
| CN | 1886612 | A | 12/2006 |
| FR | 2 815 611 | A1 | 4/2002 |
| FR | 2 862 009 | A1 | 5/2005 |

OTHER PUBLICATIONS

Chinese Office Action dated Oct. 10, 2012 issued in corresponding Chinese Patent Application No. 200980126767.6.

* cited by examiner

*Primary Examiner* — Len Tran
*Assistant Examiner* — Viet Le
(74) *Attorney, Agent, or Firm* — Sughrue Mion, PLLC

(57) ABSTRACT

A fluid dispenser pump comprising: a pump body; at least a first piston that slides in leaktight manner in said pump body on each actuation so as to expel a dose of fluid through a dispenser orifice (45) that is provided in a dispenser head (40); a closure member (38), movable between a closed position and an open position, being disposed in said dispenser head (40) upstream from said dispenser orifice (45), said closure member (38) being urged towards its closed position by a resilient element, such as a spring; said closure member (38) in the closed position co-operating in leaktight manner with said dispenser head (40) in at least three distinct sealing zones (381, 382, 383).

11 Claims, 3 Drawing Sheets

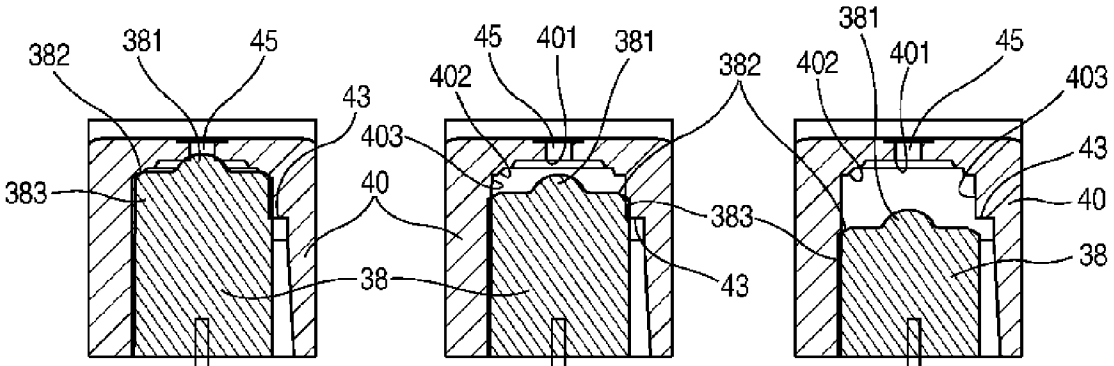
Fig. 4a
Fig. 4b
Fig. 4c
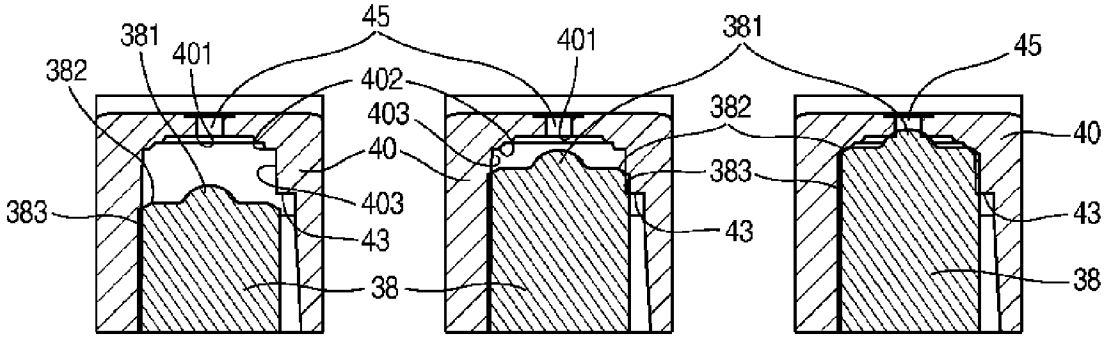
Fig. 5a
Fig. 5b
Fig. 5c

PUMP FOR DISPENSING A FLUID PRODUCT

The present invention relates to a fluid dispenser pump and to a fluid dispenser including such a pump.

Fluid dispenser pumps are well known in the prior art, in particular for dispensing fluids in the fields of cosmetics, perfumery, or pharmacy. They generally comprise a pump body in which a piston slides for dispensing a dose of fluid on each actuation. In particular with pharmaceuticals, pumps sometimes incorporate closure members that are provided for their dispenser orifices. In particular, the closure members are for avoiding contamination of the fluid between two actuations of the pump, and, at rest, are thus urged towards their closed position. Various problems may occur with closure members. Thus, sealing is generally achieved at the very end of the return stroke, hence with a time interval between the end of dispensing the dose of fluid and the effective closure of the dispenser orifice, that is likely to allow contamination to occur. In addition, during actuation, sealing is lost generally at the very start of the actuation stroke, although the dispensing of fluid often takes place at the end of the actuation stroke. Once again, the time interval may be sufficient for contamination to occur. In addition, in the closed position, in order to ensure sealing, the closure member is urged by a spring, and it thus exerts a force on the portion of the head with which it co-operates, generally the peripheral edge of the dispenser orifice. Unfortunately, in particular for nasal-spray heads, and in particular nasal-spray heads for pediatric use, the dimensions of the walls are very small, and the thrust exerted by the closure member may end up causing the head to deform, with the risk of loss of sealing, and thus the risk of contamination.

Documents FR-2 815 611, FR-2 862 009, and U.S. Pat. No. 6,609,666 describe closure members that co-operate in their closed position with the dispenser head, in two distinct sealing zones.

An object of the present invention is to provide a fluid dispenser pump that does not have the above-mentioned drawbacks.

Another object of the present invention is to provide a fluid dispenser pump that guarantees that the fluid is dispensed in the form of a fine spray each time the pump is actuated.

Another object of the present invention is to provide a fluid dispenser pump having a closure member that guarantees sealing, limits the risk of contamination, and reduces or eliminates the risk of the dispenser head deforming.

Another object of the present invention is to provide a fluid dispenser pump that is simple and inexpensive to manufacture and to assemble, and that is safe and reliable in use.

The present invention thus provides a fluid dispenser pump comprising: a pump body; at least a first piston that slides in leaktight manner in said pump body on each actuation so as to expel a dose of fluid through a dispenser orifice that is provided in a dispenser head; a closure member, movable between a closed position and an open position, being disposed in said dispenser head upstream from said dispenser orifice, said closure member being urged towards its closed position by a resilient element, such as a spring; said closure member in the closed position co-operating in leaktight manner with said dispenser head in at least three distinct sealing zones.

Advantageously, a first sealing zone is formed by a central projection of the closure member that co-operates with a peripheral edge of the dispenser head, which edge defines the dispenser orifice.

Advantageously, a second sealing zone is formed by a frustoconical peripheral edge at the side of the closure member, which edge co-operates with a corresponding frustoconical wall portion that is provided in said dispenser head.

Advantageously, a third sealing zone is formed by an axially-extending side of the closure member, which side co-operates with a corresponding axially-extending wall portion that is provided in said dispenser head.

Advantageously, the dispenser head includes a radial shoulder that is extended axially by said axially-extending wall portion that is disposed downstream from said shoulder in the flow direction of the fluid, the diameter of said axially-extending wall portion being substantially identical to the diameter of said axially-extending side of the closure member, so that during opening, said closure member slides in leaktight manner against said axially-extending wall portion as far as said shoulder, and during closing, said closure member slides in leaktight manner against said axially-extending wall portion away from said shoulder.

Advantageously, said axially-extending wall portion, disposed downstream from said shoulder, has a length of at least 0.1 millimeters (mm), preferably 0.6 mm.

Advantageously, the force exerted by the resilient element on the closure member in the closed position is transmitted to said dispenser head in three distinct force components.

Advantageously, a metering chamber is formed directly upstream from said dispenser orifice, said closure member forming the outlet valve of said metering chamber.

Advantageously, said closure member is made integrally with said pump body.

Advantageously, said first piston is made integrally with a fastener ring that is adapted to fasten the pump on a reservoir.

Advantageously, the pump includes only a single resilient element that is disposed out of contact with the fluid.

The present invention also provides a fluid dispenser device comprising a reservoir and a pump as described above, fastened to said reservoir.

These and other characteristics and advantages of the present invention appear more clearly from the following detailed description of an embodiment thereof, given by way of non-limiting example, and with reference to the accompanying drawing, in which.

FIGS. 4*a* to 4*c* are diagrammatic views showing an opening stage, respectively in the closed, intermediate, and open positions; and FIGS. 5*a* to 5*c* are diagrammatic views showing a closing stage, respectively in the open, intermediate, and closed positions.

The invention is described below with reference to a particular pump, but naturally it may apply to any type of pump or valve.

Figure 1:
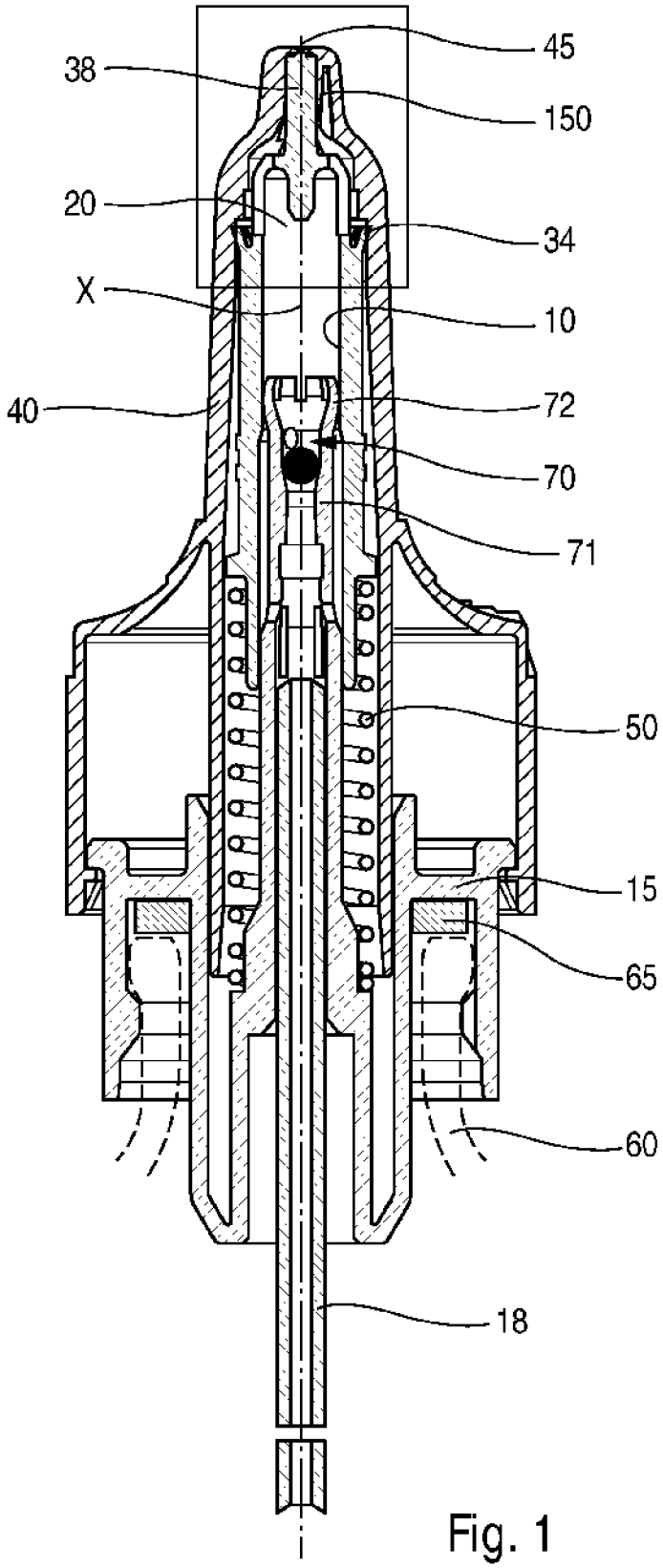
FIG. 1 is a diagrammatic section view of a fluid dispenser device including a fluid dispenser pump in an advantageous embodiment of the present invention, in the rest position of the pump.

With reference to FIG. 1, the fluid dispenser device comprises a reservoir 60 (indicated diagrammatically by dashed lines) and a pump that is mounted on said reservoir by means of a fastener ring 15, preferably with a gasket 65 interposed therebetween. These elements may be of any type and FIG. 1 shows only one particular embodiment. The pump comprises a pump body 10 defining a metering chamber 20 containing the fluid to be dispensed each time the pump is actuated, and in which a first piston 72 slides. A dispenser head 40 is mounted on the fastener ring 15, and the metering chamber 20 is advantageously formed in said head. The metering chamber further includes an inlet valve 70, and a closure member 38 is provided upstream from the dispenser orifice 45 and co-operates with said dispenser orifice between a closed position and an open or dispensing position. Since the metering chamber 20 is disposed directly upstream from the dispenser orifice 45, said closure member 38 forms the outlet valve of said metering chamber 20. The pump body 10 is advantageously made integrally with said closure member 38, and the first piston 72 may advantageously be made integrally with the fastener ring 15 and the seat 71 of the inlet valve 70. A spring 50, preferably a single spring, and preferably not in contact with the fluid, is disposed in the pump so as to return the first piston 72 to its rest position and the closure member 38 to its closed position each time the pump is actuated. Another resilient element, equivalent to the spring, could equally well be used. In addition, a dip tube 18 may be connected to said pump to extend it to the bottom of the reservoir so as to enable all of the fluid contained therein to be dispensed. A spray profile 100 may be provided at the dispenser orifice 45 to pulverize the expelled fluid each time the pump is actuated.

Figure 2:
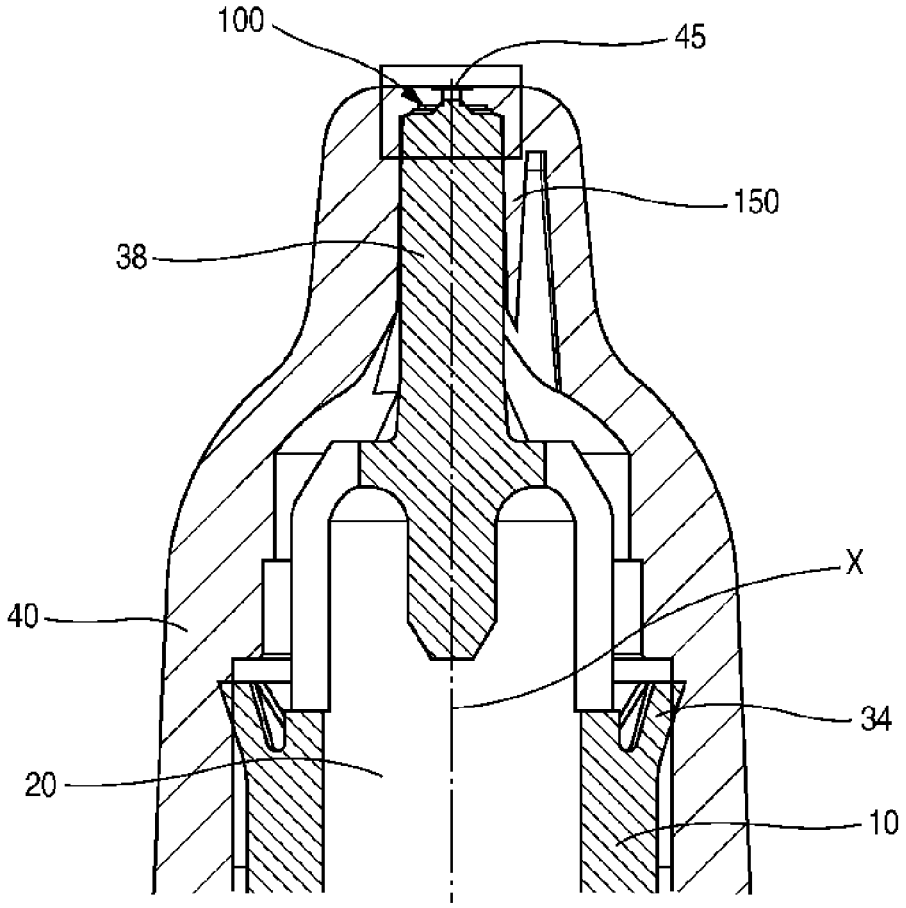
FIG. 2 is a larger-scale view of a detail boxed in FIG. 1.
Figure 3:
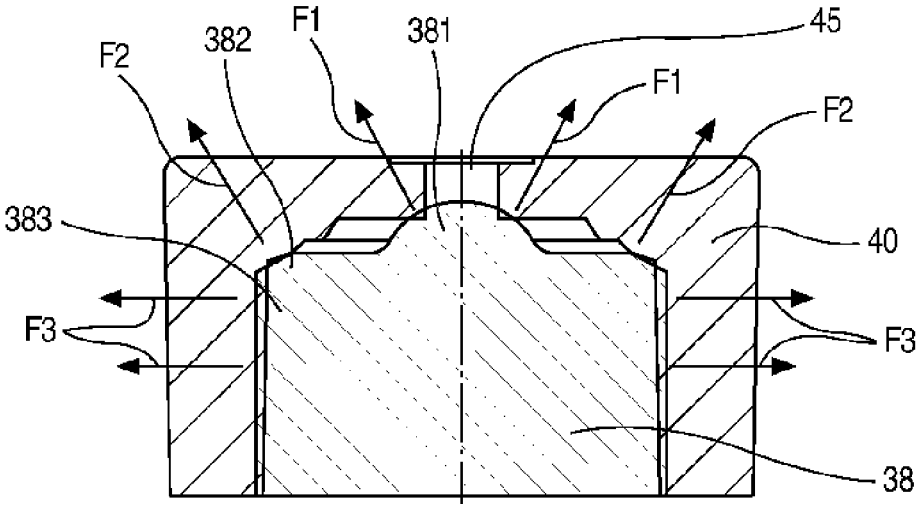
FIG. 3 is a larger-scale view of a detail boxed in FIG. 2.

FIGS. 2 and 3 show larger-scale views of an advantageous variant embodiment of the invention. In this variant embodiment, the end of the spray head 40 that incorporates the spray orifice 45, is constricted and forms a sleeve 150 in which the closure member 38 slides axially. The closure member 38 may advantageously be made integrally with a second piston 34 that may slide in leaktight manner in said dispenser head 40, as can be seen in FIGS. 1 and 2. The sleeve 150 is preferably made integrally with the end wall of the spray head 40, and it may incorporate the spray profile 100. The spray profile 100 may include a swirl chamber that may be disposed directly upstream from the spray orifice 45 and that is connected thereto in the dispensing position. The spray profile 100 may also include at least one non-radial channel, preferably two that are disposed symmetrically relative to each other, about the central axis X of the pump. Naturally, any number of non-radial channels could be envisaged. The non-radial channels may be connected to the swirl chamber when the fluid is expelled. The spray profile guarantees that the fluid is sprayed properly while it is being dispensed.

In the invention, in the closed position, said closure member 38 co-operates in leaktight manner with the inside of the dispenser head 40 in at least three distinct sealing zones 381, 382, and 383. As can be seen more clearly in FIGS. 3 to 5, the first sealing zone is preferably formed by an axial central projection 381 of the closure member 38 that co-operates in the closed position with a radial peripheral edge 401 of the dispenser head 40, which edge defines the dispenser orifice 45. A second sealing zone is preferably formed by a frustoconical peripheral edge 382 at the side of the closure member 38, which edge co-operates in the closed position with a corresponding frustoconical wall portion 402 that is provided inside the dispenser head 40. A third sealing zone is preferably formed by an axially-extending side 383 of the closure member 38, which side co-operates with a corresponding axially-extending wall portion 403 that is provided inside the dispenser head 40. Preferably, the axially-extending side 383 of the closure member 38 extends directly from said frustoconical peripheral edge 382 that forms the second sealing zone. In this configuration, the axially-extending wall portion 403 of the dispenser head 40 also extends the frustoconical wall portion 402 in corresponding manner. Although the first and second sealing zones are contact sealing zones that are opened as soon as the closure member 38 begins to move away from the dispenser orifice 45, in contrast, the third sealing zone makes it possible to maintain sealing over a fraction of the actuation stroke of the pump, thereby delaying the moment during opening when sealing is interrupted, and anticipating the moment during closing when sealing is once again established, as described more clearly below with reference to FIGS. 4 and 5. Advantageously, the dispenser head 40 includes a radial shoulder 43 that downstream from said shoulder in the flow direction of the fluid, defines said axially-extending wall portion 403 that has a smaller diameter, and upstream of said shoulder 43, defines a wall portion of greater diameter. Preferably, in order to ensure that the axially-extending wall portion 403 disposed downstream from said shoulder 43 forms the third sealing zone, the diameter of the axially-extending wall portion 403 is approximately identical to the diameter of said axially-extending side 383 of the closure member 38. Naturally, the inside diameter of the axially-extending wall portion 403 of the head cannot be greater than the outside diameter of said axially-extending side 383 of the closure member, since otherwise it would be impossible for sealing to be achieved between them. Likewise, the diameter of the axially-extending wall portion 403 cannot be significantly less than the diameter of the axially-extending side 383 of the closure member, since otherwise the closure member could not slide inside the axially-extending wall portion. Nevertheless, since the closure member 38 is urged towards its closed position by a resilient element, such as the spring 50, it is not absolutely necessary for the diameters to be exactly identical.

In the opening stage, shown in FIGS. 4*a* to 4*c*, when the user begins to actuate the pump, the closure member is urged away from the dispenser orifice 45 starting from its closed position shown in FIG. 4*a*. From the beginning of the actuation stroke, the central projection 381 of the closure member 38 lifts off the peripheral edge 401 that defines the dispenser orifice 45, and the frustoconical side peripheral edge 382 of the closure member 38 lifts off the corresponding frustoconical wall portion 402 of the dispenser head 40. This is shown in the intermediate position in FIG. 4*b*. However, in the intermediate position, the third sealing zone is maintained, since the axially-extending side 383 of the closure member 38 still slides in leaktight manner inside the axially-extending wall portion 403 disposed downstream from the shoulder 43. It is only when the end of the axially-extending side 383 reaches said shoulder 43 that the third sealing zone is also interrupted, and the fluid contained in the metering chamber 20 may be expelled through the dispenser orifice 45.

When the fluid has been expelled and the user releases the pressure on the pump, said pump is returned towards its rest position (corresponding to the closed position of the closure member) by the spring 50. This closing stage is shown in FIGS. 5*a* to 5*c*. It should be observed that starting from the open position shown in FIG. 5*a*, a small fraction of the return stroke suffices in order to reach the intermediate position shown in FIG. 5*b*, in which the third sealing zone is re-established, with the axially-extending side 383 of the closure member 38 co-operating once again in leaktight manner with the axially-extending wall portion 403 disposed downstream from the shoulder 43. Over all of the remaining return stroke, sealing is thus already re-established, thereby limiting the risk of contamination at that moment. It is only when the closure member reaches its closed position that the first and second sealing zones are re-established at the peripheral edge defining the dispenser orifice 45 and at the frustoconical wall portion 402. In order to delay effectively the loss of sealing during the actuation stroke, and in order to anticipate effectively the re-establishment of sealing during the return stroke, the length of the axially-extending wall portion 403 disposed downstream from said shoulder is at least 0.1 mm, preferably 0.6 mm. This implementation makes it possible to guarantee that the dose of fluid is dispensed in safe and reliable manner on each actuation, while limiting the risk of contamination equally well during opening and closing.

An additional advantage of the closure member of the invention is that the force exerted by the closure member 38 on the dispenser head 40 in the closed position is not transmitted exclusively onto the peripheral edge 401 defining the dispenser orifice 45, as occurs with most closure members. In particular for a nasal dispenser head, and in particular for this type of nasal-spray head for pediatric use, the dimensions of the head are very small, such that the thickness of the radial end wall that defines the dispenser orifice 45 is very small. Nevertheless, the spring 50 should be powerful enough to return the pump into its rest position and the closure member into its closed position after each actuation. It thus exerts a non-negligible force, which also makes it possible to ensure sealing in the closed position. In particular during long-term storage, the force may deform the walls of the dispenser head 40, with a risk of loss of sealing by them and thus a risk of contamination. In contrast, with the present invention, the force exerted by the spring 50 on the closure member 38 is transmitted to the dispenser head 40 as three distinct force components (F1, F2, F3), as shown in FIG. 3. Naturally, there is always the component F1 that is exerted by the central projection 381 of the closure member 38 on the radial peripheral edge 401 that defines the dispenser orifice 45. However, the component F1 is significantly less than the total force exerted by the spring 50, since a fraction of the total force is transmitted by the frustoconical side peripheral edge 382 of the closure member 38 to the corresponding frustoconical wall portion 402 of the head by the component F2, and since another portion is transmitted radially by the component F3 via the third sealing zone 383. Any risk of the wall defining the dispenser orifice 45 deforming is thus eliminated, or at least greatly reduced.

Naturally, the three sealing zones described above with reference to the drawings could be made differently from the sealing zones shown, e.g. using deformable lips or any other known means for providing sealing.

Although the invention is described above with reference to a variant embodiment thereof, naturally it is not limited by the embodiment shown, and any useful modifications could be applied thereto by a person skilled in the art, without going beyond the ambit of the present invention, as defined by the accompanying claims.

The invention claimed is:

1. A fluid dispenser pump comprising: a pump body; at least a first piston that slides in leaktight manner in said pump body on each actuation so as to expel a dose of fluid through a dispenser orifice that is provided in a dispenser head; a closure member, movable between a closed position and an open position, being disposed in said dispenser head upstream from said dispenser orifice, said closure member being urged towards its closed position by a resilient element, wherein said closure member in the closed position co-operates in leaktight manner with said dispenser head in at least three distinct sealing zones, each of said at least three distinct sealing zones being sealed and leak-tight in the closed position of said closure member and being unsealed in the open position of said closure member, the dose of fluid being expelled when said at least three sealing zones are unsealed, wherein a first sealing zone is formed by a central projection of the closure member that co-operates with a peripheral edge of the dispenser head, which edge defines the dispenser orifice, wherein a second sealing zone is formed by a frustoconical peripheral side edge surface at the side of the closure member, which edge co-operates with a corresponding frustoconical wall portion that is provided in said dispenser head, and wherein a third sealing zone is formed by an axially-extending side of the closure member, which side co-operates with a corresponding axially-extending wall portion that is provided in said dispenser head, said axially-extending side extending directly from said frustoconical peripheral side edge surface that forms the second sealing zone.

2. A pump according to claim 1, wherein the dispenser head includes a radial shoulder that is extended axially by said axially-extending wall portion (403) that is disposed downstream from said shoulder in the flow direction of the fluid, the diameter of said axially-extending wall portion being substantially identical to the diameter of said axially-extending side of the closure member, so that during opening, said closure member slides in leaktight manner against said axially-extending wall portion as far as said shoulder, and during closing, said closure member slides in leaktight manner against said axially-extending wall portion away from said shoulder.

3. A pump according to claim 2, wherein said axially-extending wall portion, disposed downstream from said shoulder, has a length of at least 0.1 mm.

4. A pump according to claim 1, wherein the force exerted by the resilient element on the closure member in the closed position is transmitted to said dispenser head in three distinct force components.

5. A pump according to claim 1, wherein a metering chamber is formed directly upstream from said dispenser orifice, said closure member forming the outlet valve of said metering chamber.

6. A pump according to claim 1, wherein said closure member is made integrally with said pump body.

7. A pump according to claim 1, wherein said first piston is made integrally with a fastener ring that is adapted to fasten the pump on a reservoir (60).

8. A pump according to claim 1, wherein the pump includes only a single resilient element that is disposed out of contact with the fluid.

9. A fluid dispenser device, comprising a reservoir and a pump according to claim 1, said reservoir pump fastened to said reservoir.

10. The pump according to claim 1, wherein said resilient element is a spring.

11. The pump according to claim 1, wherein said axially-extending wall portion has a length of 0.6 mm.

* * * * *